US010982929B2

(12) United States Patent
Rodriguez

(10) Patent No.: US 10,982,929 B2
(45) Date of Patent: Apr. 20, 2021

(54) FIREARM SLING KEEPER

(71) Applicant: Mike Rodriguez, Big Timber, MT (US)

(72) Inventor: Mike Rodriguez, Big Timber, MT (US)

( * ) Notice: Subject to any disclaimer, the term of this patent is extended or adjusted under 35 U.S.C. 154(b) by 0 days.

(21) Appl. No.: 15/416,091

(22) Filed: Jan. 26, 2017

(65) Prior Publication Data

US 2017/0211907 A1 Jul. 27, 2017

Related U.S. Application Data

(60) Provisional application No. 62/287,516, filed on Jan. 27, 2016.

(51) Int. Cl.
*F41C 33/00* (2006.01)

(52) U.S. Cl.
CPC ..... *F41C 33/002* (2013.01)

(58) Field of Classification Search
CPC ..... F41C 33/002
USPC ..... 224/150
See application file for complete search history.

(56) References Cited

U.S. PATENT DOCUMENTS 6,019,404 A * 2/2000 Pasquale ..... F41A 17/44 224/150
6,176,407 B1 * 1/2001 Jones ..... F42B 39/02 224/223
6,523,180 B1 * 2/2003 Christopher ..... A01K 15/02 119/714
6,874,618 B1 * 4/2005 Cragg ..... F42B 39/02 206/3
2008/0302838 A1 * 12/2008 Burnsed, Jr. ..... F41C 23/02 224/150
2011/0168747 A1 * 7/2011 Scott ..... F41C 23/02 224/150
2014/0203053 A1 * 7/2014 Rivas-Schlanger ..... F41C 33/002 224/150
2015/0369560 A1 * 12/2015 Chiang ..... F41C 33/002 224/150

* cited by examiner

*Primary Examiner* — Peter N Helvey
(74) *Attorney, Agent, or Firm* — Erickson Kernell IP, LLC

(57) ABSTRACT

A sling keeper for securing a sling to a firearm during storage or transport of the firearm. The sling keeper comprises a first strap and a second strap. The first strap includes a length defined by a first end and a second end, and a length. The first strap may include a first securing mechanism disposed proximate the first end and a second securing mechanism disposed proximate the second end. The first securing mechanism is mate-able with the second securing mechanism. The second strap has a first end coupled to the first strap between the first end and the second end of the first. The second strap has a second end, and a third securing mechanism disposed proximate the second end. The second strap or the first strap may include at least a fourth securing mechanism, wherein the fourth securing mechanism is mate-able with the third securing mechanism.

4 Claims, 6 Drawing Sheets

FIREARM SLING KEEPER

CROSS-REFERENCE TO RELATED APPLICATION

This application claims the benefit of U.S. Provisional Patent Application No. 62/287,516 filed Jan. 27, 2016, the entire disclosure of which is hereby incorporated by reference.

FIELD OF THE INVENTION

This present invention relates to a device used to secure a firearm sling to a firearm during storage and transport so as to prevent the sling from becoming caught or entangled when moving the firearm, for example, in the close quarters of a transport vehicle.

BACKGROUND OF THE INVENTION

Law enforcement or military personnel often carry a duty rifle or shotgun in their vehicles. Often the duty rifle or shotgun is stored above and behind the driver and front passenger in a vehicle, for instance, a squad car or patrol vehicle. Law enforcement officers or other military personnel often have other equipment in their immediate vicinity, particularly vehicle operation fixtures such as steering wheels, shift levers, turn signal levers, or other installed communication equipment fixtures, like computers or radios. As such, when the duty rifle or shotgun is deployed, the unrestrained sling of the weapon often gets wrapped around one of these fixtures or any other protruding feature in the vehicle. This can result in a delay in the deployment of a law enforcement officer or military personnel from the vehicle. This delay may put the officer, other officers, and the general public at risk.

Thus, there is a need in the art for a device to secure a sling of a duty rifle or shotgun to the firearm during storage or transport. There is also a need in the art for a device to secure a sling of a duty rifle or shotgun to the firearm during storage or transport wherein the sling can be quickly deployed.

SUMMARY OF THE INVENTION

The present invention is directed toward a sling keeper to secure a sling to a firearm during the storage or transport of the firearm. The sling keeper of the present invention may include a first strap having a first end, a second end, an exterior surface, and an interior surface, wherein the first end and the second end define a length of the first strap. The first strap may also include a first securing mechanism disposed on the interior surface and located proximate the first end of the first strap. The first strap may also include a second securing mechanism disposed on its exterior surface and located proximate the second end of the first strap. The first securing mechanism of the first strap may be mate-able with the second securing mechanism of the first strap or any other securing mechanism of the sling keeper.

The present sling keeper may also include a second strap coupled to the first strap between the first end and the second end of the strap. The second strap may include a first end, a second end, an exterior surface and an interior surface. The first end of the second strap may be coupled to the first strap. The second strap may further comprise a third securing mechanism disposed on the interior surface of the second strap proximate the second end and a fourth securing mechanism disposed on at least one of the exterior surface of the first strap or the exterior surface of the second strap. The fourth securing mechanism may be mate-able with the third securing mechanism or any other of the securing mechanisms.

In one embodiment, the first strap of the sling keeper may be elastic or inelastic. In one embodiment, the second strap of the sling keeper may be elastic or inelastic. In another embodiment, the sling keeper may include the first strap being inelastic and the second strap being elastic.

In another embodiment, the second strap of the sling keeper may be coupled to the exterior surface of the first strap within the middle third of the length of the first strap.

Other aspects and advantages of the present invention will be apparent from the following detailed description of the preferred embodiments and the accompanying drawing figures.

Figure 1:
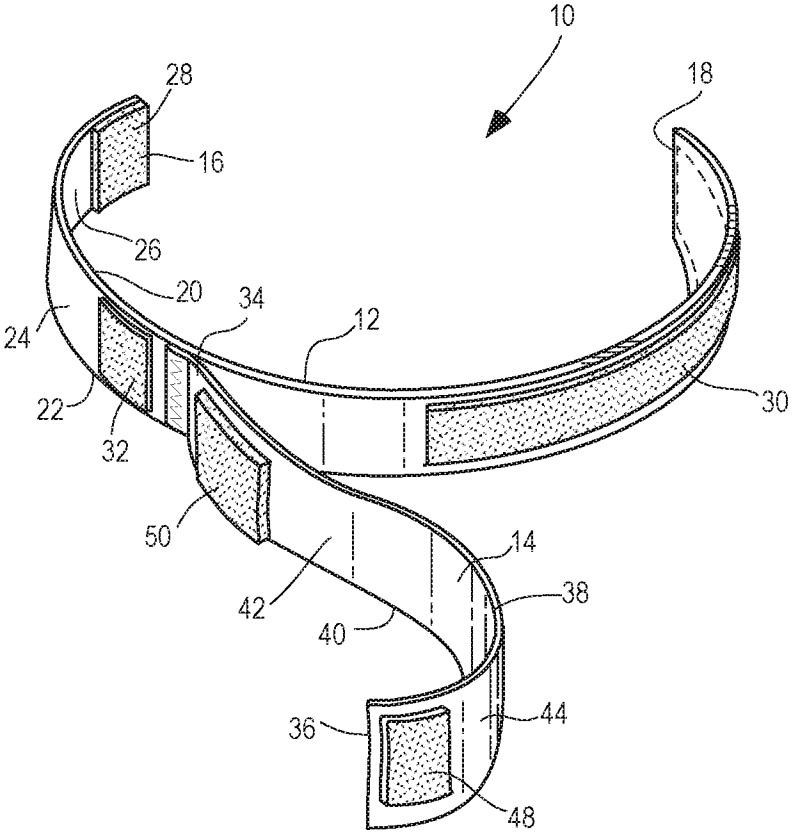
FIG. 1 is a perspective view of one embodiment of a sling keeper in accordance with the teachings of the present disclosure.

While the disclosure is susceptible to various modifications and alternative forms, a specific embodiment thereof is shown by way of example in the drawing and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

The present invention relates to a device for securing a sling to a firearm during storage or transport. The present invention may also be configured so the sling is quickly releasable during deployment of the firearm.

Figure 2:
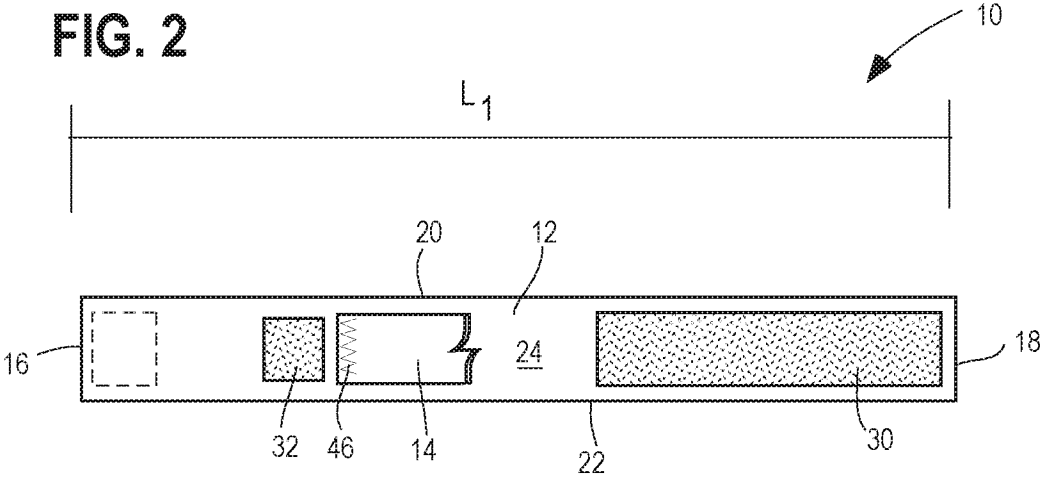
FIG. 2 is a front view of one embodiment of a sling keeper in accordance with the teachings of the present disclosure.

FIG. 1 illustrates an embodiment of the sling keeper 10 of the present invention. Sling keeper 10 comprises a first strap 12 and a second strap 14 coupled to the first strap 12. The first strap 12 includes a first end 16, a second end 18, a first side 20, a second side 22, an exterior surface 24, and an interior surface 26. As shown in FIG. 2, first end 16 and second end 18 may define a length L1 of first strap 12. Turning back to FIG. 1, first strap 12 may also include one or more of a first securing mechanism 28, a second securing mechanism 30, and a third securing mechanism 32. As shown, first securing mechanism 28 may be disposed on the interior side 26 of first strap 12 proximate first end 16. Second securing mechanism 28 may be disposed on the exterior side 24 of first strap 12 proximate second end 18 and extend toward first end 16 along a portion of length L1. Third securing mechanism 32 may be disposed on exterior side 26 of first strap 12 between first end 16 and second end 18 as shown in FIGS. 1 and 2.

Figure 3:
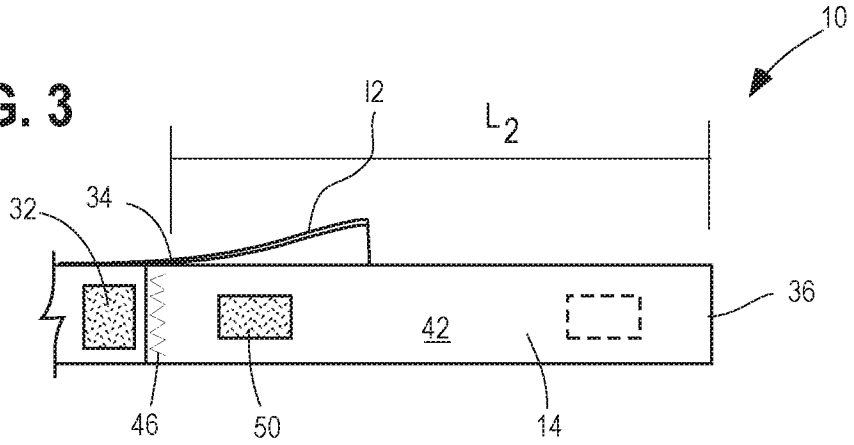
FIG. 3 is a back view of one embodiment of a sling keeper in accordance with the teachings of the present disclosure.

FIG. 1 further illustrates second strap 14 having a first end 34, a second end 36, a first side 38, a second side 40, an exterior surface 42 and an interior surface 44. As shown in FIG. 3, first end 34 and second end 36 may define a length L2 of second strap 14. FIGS. 1 and 3 show second strap 14 coupled to first strap 12 at a joint 46, wherein the joint is between first end 16 and second end 18 of first strap 12. Joint 46 may be located in the middle third of the length L1 of first strap 12. Joint 46 may be any type of joint coupling second strap 14 to first strap 16, including a sewn joint, a welded joint, a glued joint, a mechanically fastened joint (such as a rivet or staple), or any other known joint. As shown in FIG. 1, second strap 14 may also include a fourth securing mechanism 48 disposed on interior surface 44 proximate second end 36 of second strap 14. Second strap 14 may also include a fifth securing mechanism 50 disposed on exterior surface 42 proximate first end 34. Other securing mechanisms (not shown) may be positioned on exterior surface 24 or 42 along the length of both straps 12 and 14.

Straps 12 and 14 may be made from any material known in the art, including nylon webbing, cotton cloth, elastic bands, elastic fabric, rope, bungee cords, shock cords, polymer sheet material, neoprene, rubber, cotton, canvas, or any woven or non-woven fabric or material, or any combination thereof. In one embodiment, first strap 12 is nylon webbing and second strap 14 is an elastic fabric. However, other configurations are also within the scope of the present invention.

Securing mechanisms 28, 30, 32, 48, and 50 can be any securing mechanism now known or hereafter developed. Securing mechanisms 28, 30, 32, 48, and 50 could be one of a mating portion of a hook and loop fastener, a snap, a button, a clip, a clasp, a snap, a hook and eye, or any other mating fastener for temporarily securing two straps.

Figure 4:
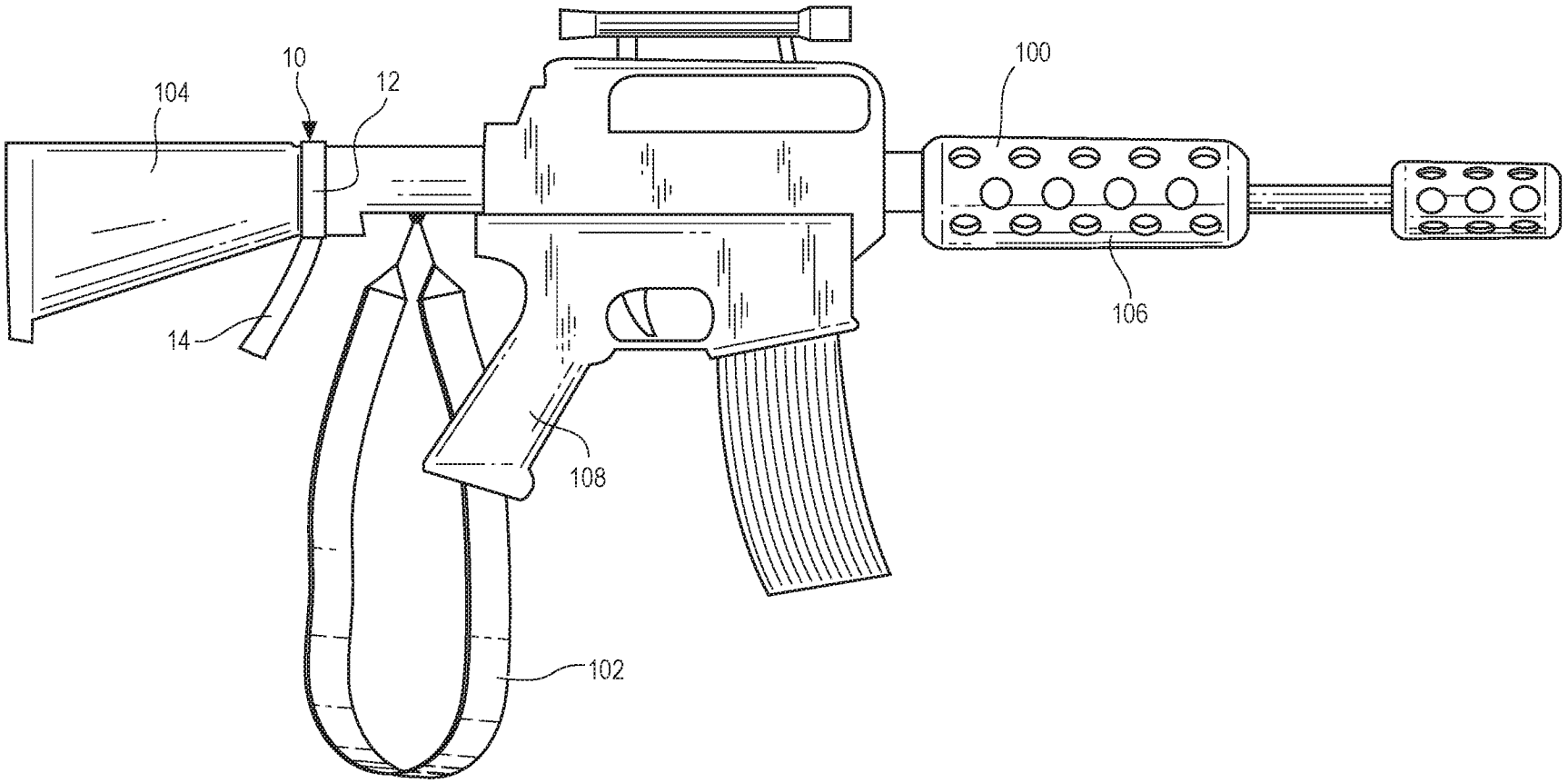
FIG. 4 is a front view of one embodiment of a sling keeper installed on a firearm at a first location in accordance with the teachings of the present disclosure.
Figure 5:
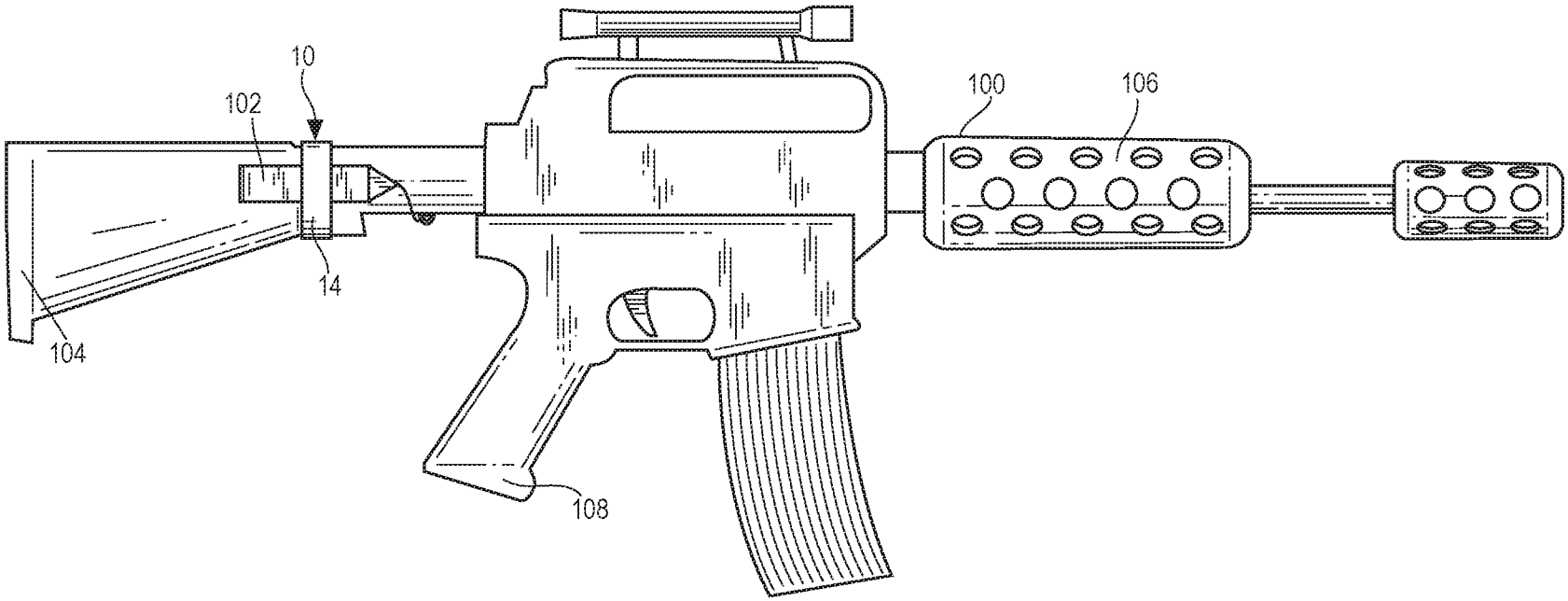
FIG. 5 is a front view of the embodiment of the sling keeper of FIG. 4, wherein the sling is being kept by the sling keeper in accordance with the teachings of the present disclosure.

In use, sling keeper 10 is wrapped around a portion of a firearm and the two straps work cooperatively to secure a sling of a firearm to the firearm during transport and storage. FIGS. 4 and 5 illustrate one way in which sling keeper 10 of the present invention can be utilized. FIG. 4 illustrates when a sling 102 of a rifle 100 is coupled to the rifle 100 proximate the stock 104, but before the grip 108 of the rifle. However, sling keeper 10 could be attached to a rifle or shotgun at any location along the length of rifle 100, most preferably in a location that does not interfere with the operation of the firearm 100 or the user's ability to carry the firearm 100 with the sling 102 in a secured position. The first strap 12 of the present sling keeper 10 is wrapped around stock 104 of rifle 100 and secured thereto. First securing mechanism 28 (FIG. 1) is the hook portion of a hook and loop fastener and second securing mechanism 30 is the loop portion of a hook and loop fastener.

Sling keeper 10 is coupled to the stock by wrapping the first strap 12 around stock 104 such that the interior surface 26 (FIG. 1) is against the outer surface of stock 104. First securing mechanism 28 (FIG. 1) is then pulled to overlap a portion of second securing mechanism 30 (FIG. 1) and pressed against it to removably couple first securing mechanism and second securing mechanism. The length of second securing mechanism 30 (see FIGS. 1 and 2) allows the first securing mechanism 28 of the present sling keeper 10 to be secured at a number of positions and therefore, the present sling keeper 10 may be utilized on a variety of rifle or shotgun makes and models. Alternatively, other methods of accommodating various stock 104 circumferences may be implemented with other types of securing mechanisms, such as placing a plurality of individual fasteners at interval spacing inward along a portion of the length L1 from second end 18. In an alternative embodiment, sling keeper 10 may be made for particular makes and models of rifles or shotguns and, therefore, first securing mechanism 28 and second securing mechanism 30 may be more precisely sized and positioned on first strap 12.

At this point, second strap 14 hangs loose and sling 102 is also in a loose position as shown in FIG. 4. Now turning to FIG. 5, the sling 102 is shown in a secured position. Sling 102 may be folded over itself and secured to stock 104 using the present sling keeper 10. The folded sling 102 is positioned against the exterior surface 24 (FIG. 1) of first strap 12, and the second strap 14 is wrapped around stock 104, over the sling 102, and over first strap 12, wherein fourth securing mechanism 48 (FIG. 1) is secured to one of the third securing mechanism 32 (FIG. 1) or the fifth securing mechanism 50 (FIG. 1), depending upon the circumference of stock 104 and/or the elasticity of second strap 14. When second strap 14 is an elastic member, it can stretch and then the contraction of the elastic portion tightly constricts the folded sling 102 against stock 104 as shown. If second strap 14 is nylon webbing or similar material, the same function can be achieved by pulling the second strap 14 taut against stock 104.

In one embodiment, fourth securing mechanism 48 is the hook portion of a hook and loop fastener and third securing mechanism 32 and fifth securing mechanism 50 are the loop portion of a hook and loop fastener.

Figure 6:
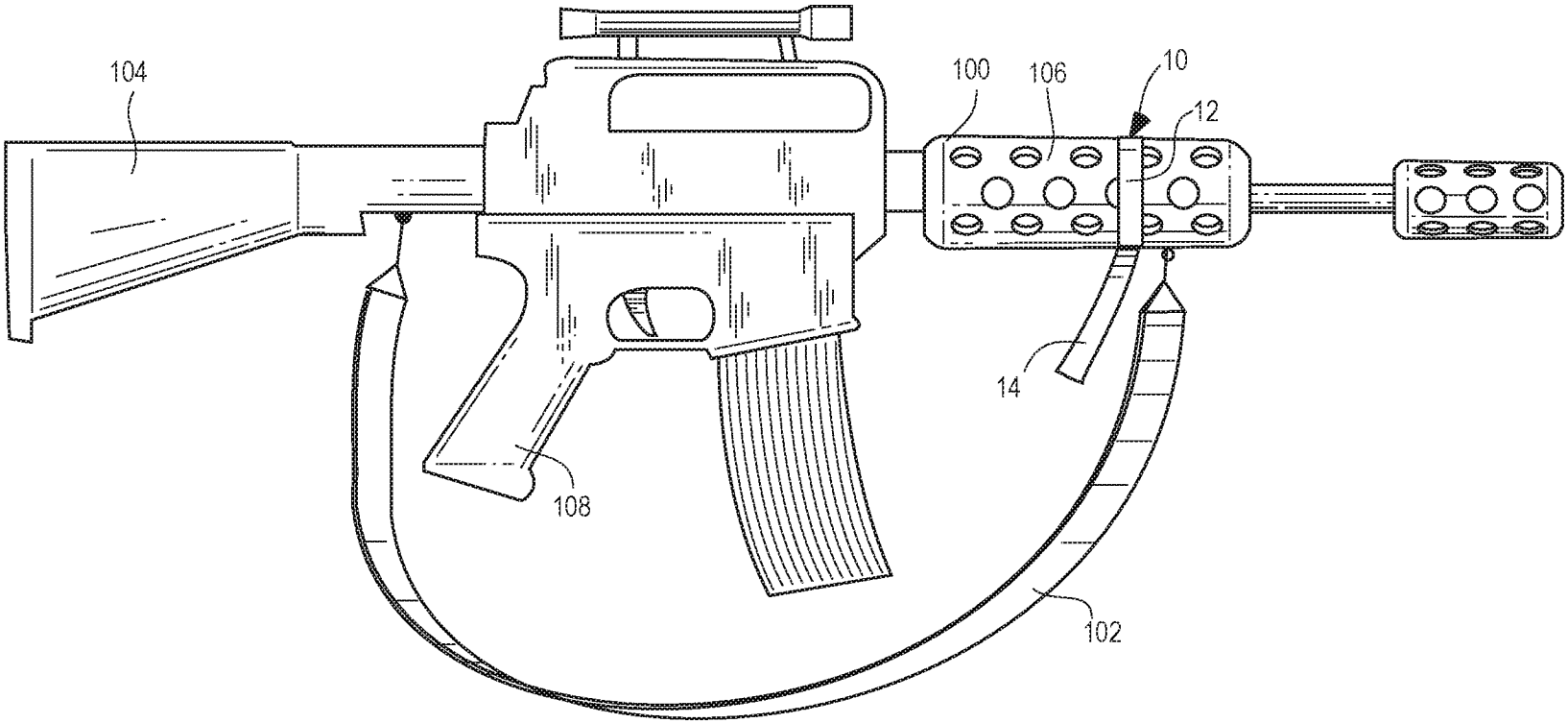
FIG. 6 is a front view of one embodiment of a sling keeper installed on a firearm at a second location in accordance with the teachings of the present disclosure.
Figure 7:
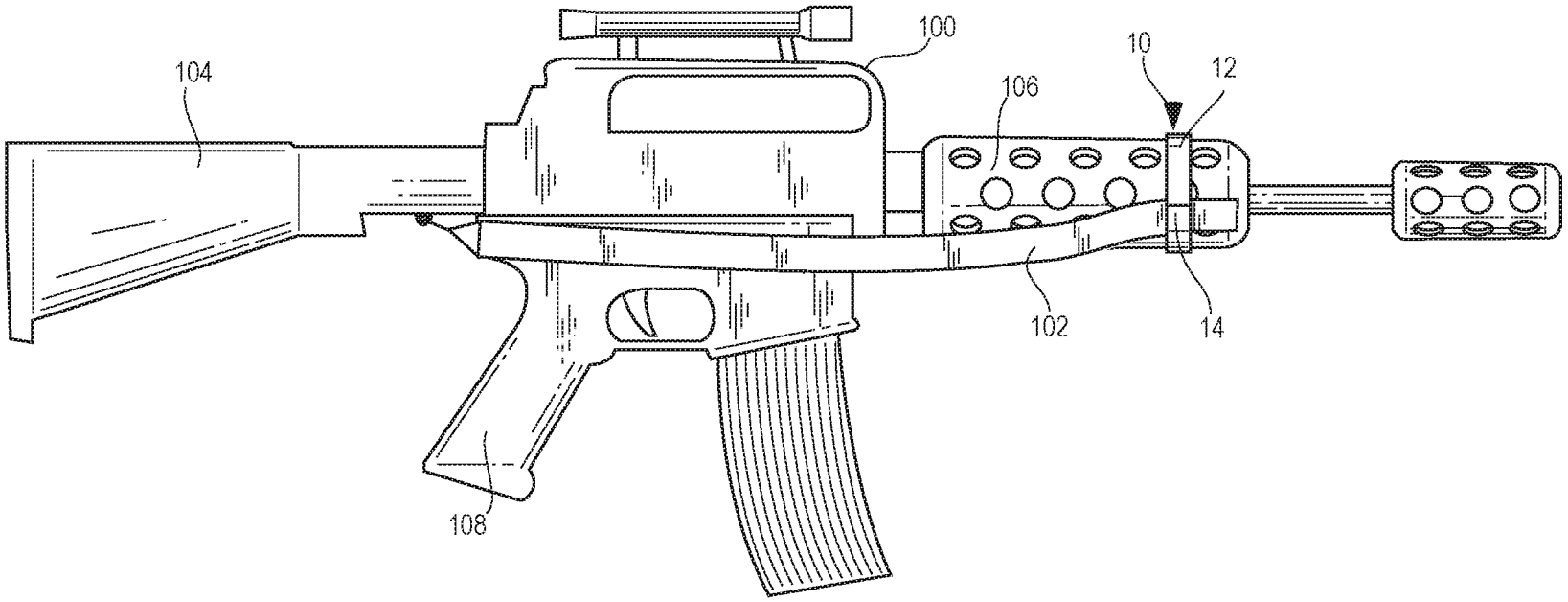
FIG. 7 is a front view of the embodiment of the sling keeper of FIG. 6, wherein the sling is being kept by the sling keeper in accordance with the teachings of the present disclosure.

FIGS. 6 and 7 illustrate another way in which sling keeper 10 of the present invention can be utilized. FIG. 6 illustrates when sling 102 of a rifle 100 is coupled to the rifle 100 proximate the stock 104 at one end and proximate a fore-stock 106 (a handguard depending upon the type of rifle or shotgun) at the other end. The first strap 12 of the present sling keeper 10 is wrapped around fore-stock 106 of rifle 100 and secured thereto. First securing mechanism 28 (FIG. 1) is the hook portion of a hook and loop fastener and second securing mechanism 30 is the loop portion of a hook and loop fastener. Sling keeper 10 is coupled to the fore-stock 106 by wrapping the first strap 12 around fore-stock 106 such that the interior surface 26 (FIG. 1) is against the outer surface of fore-stock 106. First securing mechanism 28 (FIG. 1) is then pulled to overlap a portion of second securing mechanism 30 (FIG. 1) and pressed against it to removably couple first securing mechanism 28 and second securing mechanism 30.

At this point, second strap 14 hangs loose and sling 102 is also in a loose position as shown in FIG. 6. Now turning to FIG. 7, the sling 102 is shown in a secured position. Sling 102 may be pulled tight along a portion of the length of the firearm 100 and may be folded over itself and secured to fore-stock 106 using the present sling keeper 10. The folded sling 102 is positioned against the exterior surface 24 (FIG. 1) of first strap 12, and then second strap 14 is wrapped around fore-stock 106, over sling 102, and over first strap 12 wherein fourth securing mechanism 48 (FIG. 1) is secured to one of the third securing mechanism 32 (FIG. 1) or fifth securing mechanism 50 (FIG. 1), depending upon the circumference of fore-stock 106 and/or the elasticity of second strap 14. When second strap 14 is an elastic member, it can also be stretched and then the contraction of the elastic portion tightly holds the folded sling 102 against fore-stock 106 as shown.

In one embodiment, the securing mechanisms may be hook and eye fasteners, wherein fourth securing mechanism 48 is a hook and third securing mechanism 50 and/or fifth securing mechanism 32 is an eye.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

I claim:

1. A sling keeper system to secure a sling to a firearm comprising:

a sling keeper comprising a first strap having a first end, a second end, an exterior surface and an interior surface, the first end and the second end defining a length;

the first strap comprising a first securing mechanism disposed on the interior surface of the first strap proximate the first end and a second securing mechanism disposed on the exterior surface of the first strap proximate the second end, the first securing mechanism mateable with the second securing mechanism;

the sling keeper further comprising a second strap coupled to the first strap between the first end and the second end of the first strap, the second strap having a first end, a second end, an exterior surface and an interior surface, wherein the first end of the second strap is coupled to the first strap;

the second strap further including a third securing mechanism disposed on the interior surface of the second strap proximate the second end, and a fourth securing mechanism disposed on the exterior surface of the second strap, the fourth securing mechanism mateable with the third securing mechanism;

the first strap further comprising a fifth securing mechanism disposed on the exterior surface of the first strap, the third securing mechanism mateable with the fifth securing mechanism; and wherein in use, said first strap is wrapped around a portion of a firearm and said second strap is wrapped over a sling to secure a portion of the sling between the first strap and the second strap.

2. The sling keeper system of claim 1 further comprising the first strap being inelastic.

3. The sling keeper system of claim 2 further comprising the second strap being elastic.

4. The sling keeper system of claim 1 further comprising the second strap being coupled to said first strap in the middle third of the length of said first strap.

* * * * *